US012241250B2

(12) United States Patent
Buchmeiser et al.

(10) Patent No.: US 12,241,250 B2
(45) Date of Patent: Mar. 4, 2025

(54) PRESTRESSED CONCRETE BODY, METHOD FOR THE PRODUCTION THEREOF, AND USE OF SAME

(71) Applicant: DEUTSCHE INSTITUTE FÜR TEXTIL-UND FASERFORSCHUNG DENKENDORF, Denkendorf (DE)

(72) Inventors: Michael Buchmeiser, Remshalden (DE); Frank Hermanutz, Leonberg (DE)

(73) Assignee: DEUTSCHE INSTITUTE FÜR TEXTIL-UND FASERFORSCHUNG DENKENDORF, Denkendorf (DE)

( * ) Notice: Subject to any disclaimer, the term of this patent is extended or adjusted under 35 U.S.C. 154(b) by 505 days.

(21) Appl. No.: 17/601,350

(22) PCT Filed: Mar. 26, 2020

(86) PCT No.: PCT/EP2020/058583

§ 371 (c)(1),
(2) Date: Oct. 4, 2021

(87) PCT Pub. No.: WO2020/201023

PCT Pub. Date: Oct. 8, 2020

(65) Prior Publication Data

US 2022/0170267 A1 Jun. 2, 2022

(30) Foreign Application Priority Data

Apr. 4, 2019 (DE) ..... 10 2019 108 908.5

(51) Int. Cl.
*E04C 5/07* (2006.01)
*E04C 5/08* (2006.01)

(52) U.S. Cl.
CPC ..... *E04C 5/07* (2013.01); *E04C 5/085* (2013.01)

(58) Field of Classification Search
None
See application file for complete search history.

(56) References Cited

U.S. PATENT DOCUMENTS 3,489,626 A * 1/1970 David ..... B29C 70/865 156/173
3,520,749 A 7/1970 Rubenstein
3,533,203 A * 10/1970 Fischer ..... E04C 5/08 52/223.14
5,863,478 A * 1/1999 Ruf ..... D01F 2/00 264/210.8

FOREIGN PATENT DOCUMENTS

KR 20100035257 A 4/2010

OTHER PUBLICATIONS

International Search Report for PCT/EP2020/058583, Mailed Jul. 22, 2020, 4 pages.

* cited by examiner

*Primary Examiner* — Shawn Mckinnon
(74) *Attorney, Agent, or Firm* — Lippes Mathias LLP

(57) ABSTRACT

The invention relates to a prestressed concrete body, containing prestressed filament yarns based on cellulose and/or cellulose derivatives. Advantageously, said prestressed concrete body is produced in that: 1.) filament yarns based on cellulose and/or derivatives thereof are clamped into a shaping container, 2.) the clamped filament yarns are wetted with water to make them swell, 3.) a prestress of approximately 0.5 to 10.0 kg/4000 dtex is applied to the wetted filament yarns, 4.) liquid concrete is poured into the shaping container containing the prestressed filament yarns, 5.) the liquid concrete in the shaping container is cured to form precast concrete, maintaining the specified applied prestress. Useful application possibilities are opened up by the invention. Use as components or structural elements with low brittleness and/or high resistance to corrosion, especially in bridge building, especially in bridge girders, in constructing containers, in constructing high-rise structures, in the production of hollow floors or ceilings, hollow core planks, precast floors or ceilings and for recycling once the service life has passed by being ground into concrete granules is advantageous.

19 Claims, No Drawings

PRESTRESSED CONCRETE BODY, METHOD FOR THE PRODUCTION THEREOF, AND USE OF SAME

The invention relates to a prestressed concrete body, into which fibres in the form of filament yarns are incorporated, and to the production and specific possible uses of same.

Prestressed concrete is a variant of reinforced concrete with an additional external longitudinal force. This is applied by tensioned steel inserts made of high-strength prestressing steel, which "compress" the concrete. The construction method is used mainly for beams and bridge girders and allows for greater spans at the same construction heights compared to reinforced concrete.

Prestressed concrete differs from other reinforced concrete by a planned prestressing (=prestretching) of the steel inserts, the tendons. The prestressed tendons are supported on the concrete here by their anchors or directly by bonding with the concrete, whereby the concrete is subjected to a compressive load and a moment load due to any eccentricity of the anchorage relative to the cross-sectional centre of gravity. In addition, deflection forces are generated in the case of curved or buckled tendon guides. The component is loaded by the prestressing in such a way that no or only small concrete tensile stresses are present in the concrete cross-section when superimposed with the external actions such as self-weight. Since concrete can only absorb low tensile stresses (approximately 10% compared to the compressive stress) before it cracks, but high compressive stresses, the prestressed (pressed) concrete is more usable. The component is stiffer in the region of service loads due to a lack of or greatly reduced cracking and therefore exhibits smaller deformations (deflections) in the case of large spans and high loads. An increase in the bearing load can be achieved by using prestressing steel, as this has a higher strength compared to normal reinforcing steel. Prestressed concrete is used today especially in bridge construction, but also in the construction of containers or high-rise structures, in structural girders, or for hollow core planks or prefabricated prestressed concrete slabs.

The prestressing wires or strands are bonded to the concrete with frictional engagement so that there is practically no relative displacement between the two materials. In the case of prestressing with immediate bond, there is a direct bond between the prestressing steel and the concrete. This method is mainly used in the prestressing bed of precast factories, where prestressing wires or strands tensioned against external abutments are concreted into the precast element. After concreting and hardening of the concrete, the prestressing is released. Due to the bond between concrete and prestressing steel as well as a wedging of the relaxed wire (or strand) (Hoyer effect), the prestressing force is applied in the precast element. This type of prestressing is only possible with straight prestressing steel. It is used, for example, for the production of concrete railway sleepers and prestressed concrete hollow core planks.

A major disadvantage of the prior art is the strong sensitivity to corrosion of the high-strength steels used:

Since creep and shrinkage of the concrete reduce the prestressing forces of the tendons, especially high prestretching of the prestressing steel is necessary. This means that, for a given prestressing force, the cross-sectional area of the tendon should be as small as possible. This can only be achieved by using high-strength steels. However, the steels of the tendons of the prestressed concrete components, which steels are under high tensile stresses, are especially sensitive to corrosion. The corrosion protection by grouting for this type of concrete must therefore be carried out with especial care.

The above-described technology has led to a variety of disadvantageous phenomena: Due to a lack of experience with the new technology and underestimation of environmental influences, collapses, necessary demolitions or costly repairs of various prestressed concrete structures occurred in the post-war period. Problems with stress corrosion cracking of prestressing steels (for example Neptune steel), ignorance of building material properties (different E-moduli of concrete depending on the aggregates used) and imperfections of the calculation methods (neglect of temperature gradients in the cross-section) also played an important role. Detecting damaged reinforcing elements is extremely time-consuming and costly: The use of replaceable external prestressing in bridge construction is intended to further improve robustness and thus extend service life. In addition, it is possible to detect cracks in the prestressing steels, even in the already existing, possibly critical, constructions, by using the prestressing wire break detection method.

The invention is based on the aim of remedying the above-mentioned disadvantages of the prior art, especially to avoid the problems mentioned with stress corrosion cracking in prestressed concrete bodies and to achieve an improvement in the robustness and thus an extension of the service life of, for example, bridge construction elements. In addition, the invention is intended to open up the possibility of remedying the effect of cracking in the prestressed concrete body, even in already existing critical constructions.

This aim is addressed in accordance with the invention by a prestressed concrete body which is characterised in that the prestressed concrete body contains prestressed filament yarns based on cellulose and/or cellulose derivatives.

The invention is subject to a variety of embodiments, as follows: It is especially advantageous if the prestress applied to the filament yarns is approximately 0.5 kg to 10.0 kg/4000 dtex, preferably approximately 1.0 kg to 8 kg/4000 dtex, especially approximately 2.0 to 6.0 kg/4000 dtex. It is also expedient to pay attention to the fineness of the individual filaments of the prestressed filament yarns. For example, it is preferred if the fineness of the individual filaments of the prestressed filament yarns is approximately 0.4 to 10.0 dtex (according to DIN EN 1973/year 1995), preferably approximately 0.6 to 6.0 dtex, and especially approximately 1.0 to 3 dtex. It is also expedient to measure the quantity of prestressed filament yarns contained in the prestressed concrete body. It has proven to be advantageous here if the prestressed concrete body contains approximately 0.1 to 20 wt. %, preferably approximately 0.5 to 14.0 wt. %, and especially approximately 1.0 to 6.0 wt. % prestressed filament yarns. It remains a mandatory feature of the invention that the prestressed concrete body contains specific prestressed filament yarns. However, in individual cases it can be advantageous if the prestressed concrete body additionally contains non-prestressed filament yarns, especially in the form of textiles, wherein it can be assumed that these can also be fibres, consequently not only continuous fibres, such as filaments. Among the textiles, woven fabrics, warp-knitted fabrics, laid scrims, nonwoven fabrics and/or weft-knitted fabrics have been found to be advantageous. The advantages associated with this are that the brittle fracture behaviour is additionally improved and an increase in the elongation at break is achieved.

It is true that the type of prestressed filament yarns is not to be regarded as critical for the purposes of the present invention. Nevertheless, it has been shown to be advantageous if the prestressed filament yarns are based on regenerated cellulose fibres, especially produced by the viscose or the lyocell method or by spinning cellulose from solution thereof in ionic liquids. In this case, it is especially advantageous if the prestressed filament yarns are based on viscose fibres, especially in the form of cord fibres. The advantages of using regenerated cellulose fibres as prestretched filament yarns are especially evident in the fact that the yarns can be advantageously stretched when wet. The invention can be realised not only by means of prestressed filament yarns based on cellulose, as already mentioned above, but also by the sole or simultaneous use of filament yarns based on cellulose derivatives. Here, it has been shown to be advantageous if the prestressed concrete body contains prestressed filaments based on cellulose derivatives in the form of cellulose esters, preferably in the form of cellulose acetate and/or cellulose allophanate.

It is true that the arrangement of the filaments, especially in the longitudinal direction (tensile direction) of the prestressed concrete body according to the invention, is not to be evaluated critically. However, it is advantageous if the filament yarns are arranged parallel in one or more planes.

The prestressed concrete body according to the invention is advantageously characterised by its structural features in that the prestressed concrete body has a flexural modulus of approximately 20 GPa to 0.1 GPa, preferably of approximately 10 GPa to 0.5 GPa, especially of approximately 8 GPa to 1 GPa (according to DIN EN 14488/year 2005), a bending force of approximately 100 to 0.2, preferably of approximately 80 to 1, especially of approximately 60 to 3 MPa (according to DIN EN 14488/year 2005), and/or an elongation at break of approximately 5 to 0.5, preferably of approximately 4 to 0.8, especially of approximately 3 to 1% (according to DIN EN 14488/year 2005).

In the following, an especially advantageous method will be described, by which the prestressed concrete body according to the invention is expediently produced: The method followed is that 1.) filament yarns based on cellulose and/or derivatives thereof are clamped into a shaping container, 2.) the clamped filament yarns are wetted with water to make them swell, 3.) a prestress of approximately 0.5 to 10.0 kg/4000 dtex is applied to the wetted filament yarns, 4.) liquid concrete is poured into the shaping container containing the prestressed filament yarns, 5.) the liquid concrete in the shaping container is cured to form precast concrete, maintaining the applied prestress.

Firstly, the above-described filament yarns based on cellulose and/or derivatives thereof are clamped into a shaping container. This container is not subject to any significant restrictions. It can, for example, be a rectangular body. The clamping is done by fixing the yarns at one end face and allowing them to exit through a perforated aperture from the other end face, where the tensile load is applied. After the filament yarns have been clamped, they are wetted with water, preferably water at a temperature of 10 to 60° C., to swell them as much as possible. As a rule, it could be stated here that about 0.5 to 2 g of water, which is advantageously adjusted to a temperature of 10 to 40° C., are required for 1 g of filament yarn. In this way, the required swelling is achieved.

Subsequently, in step 3), the filament yarns are subjected to a prestressing of 0.5 to 10.0 kg/4000 dtex. More specifically, the following approach is adopted: The filament yarns are brought together after the aperture to form a master yarn and are guided via a roller to the tensioning machine, via which a tensile force is applied in a controlled manner.

Lastly, liquid concrete is poured into the shaping container containing the prestressed filament yarns. It is clear here to a person skilled in the art that he can use any cement, especially Portland cement, a mixture of cement with sand and/or gravel and the like. There is also the possibility of adding aggregate as an additive. The mixing water initiates the chemical setting process, i.e. the hardening. In order to influence the workability and further properties of the concrete, concrete additives and concrete admixtures, known to a person skilled in the art, can also be added to the mixture. Most of the water is chemically bound during the cement setting process.

The method according to the invention can be designed advantageously in many ways: For example, it is expedient if the prestress in step 3.) is set to approximately 1.0 kg to 8.0 kg/4000 dtex, especially approximately 2.0 kg to 6.0 kg/4000 dtex.

In order to achieve optimum success with the invention, it is expedient to consider the fineness. For example, it is advantageous if the fineness of the individual filaments of the prestressed and the optional non-stressed filament yarns is about 0.4 to 10.0 dtex, preferably about 0.6 to 6.0 dtex, and especially about 1.0 to 3.0 dtex (according to EN ISO 1973).

In order to optimise the invention, it is pertinent to pay attention to the amount of prestressed filament yarns contained in the prestressed concrete according to the invention. For example, it is advantageous if the prestressed filament yarns are contained in the liquid concrete introduced in step 4.) in an amount of approximately 0.1 to approximately 20 wt. %, preferably of approximately 0.5 to 14.0 wt. %, and especially of approximately 1.0 to 6.0 wt. %.

It is not absolutely necessary that the prestressed concrete body according to the invention contains prestressed filament yarns alone. Rather, in individual cases it can lead to especial advantages if non-pre-stressed filament yarns, especially in the form of textiles, are incorporated, moreover especially before step 4.). The advantages resulting from this have already been mentioned above, especially when the textiles are used in the form of woven fabrics, warp-knitted fabrics, laid scrims, nonwoven fabrics and/or weft-knitted fabrics.

The type of especial filament yarns has already been discussed above. It has therefore also proven to be expedient if regenerated cellulose yarns, especially those that are produced by the viscose or the lyocell method or by spinning of cellulose from ionic liquids, are used as filament yarns for providing prestressed filament yarns in the prestressed concrete. The advantages of these regenerated-cellulose filament yarns are that the yarns are made from continuous fibres and fibres with high moduli of elasticity are obtained via these methods. These advantages are achieved especially when the filament yarns based on viscose fibres are cord fibres ("tyre cord fibres").

In summary, it can be stated that the disadvantages of the prior art described at the outset are addressed in accordance with the invention especially by using special high-strength filament yarns instead of steel. By using high-performance filament yarns that are stretchable when wet, such as especially filament yarns based on cellulose tyre cord, it is possible to apply stress to the fibres or to the yarns, which are fixed in the concrete during curing. In one embodiment, the fibre cords are exposed to high forces in a wet state in the concrete mould. This stretched state results in a prestress in the prestressed concrete body that results ultimately. After the fresh concrete has hardened and dried, the prestressed filament yarns are fixed in place. The entire prestressing force is transferred to the concrete element. Especially advantageous are industrial filament yarns based on cellulose, but also on cellulose derivatives or both materials. Rayon filament fibres, especially those based on tyre cord, are especially advantageous. These can be stretched very well and introduce a desirably high tensioning force into the prestressed concrete body and improve its working capacity. The filament cables in this embodiment are completely alkali-resistant and absolutely corrosion-resistant. It is especially advantageous here if established techniques for tensioning can be used directly. Furthermore, the easy disposal and recycling of the concrete elements, as there is no need for the time-consuming cutting of steel, is of great benefit.

On the basis of the above considerations, the question arises in which areas the prestressed concrete body according to the invention can be used with especial advantage. Use of the prestressed concrete body as a component or structural element with low brittleness and/or high resistance to corrosion, especially in bridge building, especially in bridge girders, in constructing containers, in constructing high-rise structures, in structural girders, in the production of hollow floors or ceilings, hollow core planks, precast floors or ceilings and for recycling once the service life has passed by being ground into concrete granules has proven to be especially advantageous.

The invention will be explained in greater detail hereinafter on the basis of examples:

EXAMPLES 1 TO 4

Regenerated cellulose yarns (manufactured and distributed by Cordenka GmbH) type Cordenka 700 (1840 dtex) are threaded into an aperture of a cement mould of size 15×6×3 cm in several rows and stressed with a tensile load of 1 kg/4000 dtex. The fibres are sprayed with water and stretched. Portland limestone cement (produced by the company Heidelberger Zement) EN 197 is mixed in a ratio of 1 part cement/0.4 parts water according to the instructions. The mass is poured evenly into the mould. The cast specimen is cured and dried at 20° C. for 28 days. The sample can be removed from the mould after 28 days drying time. The mechanical measurement was carried out on a Zwick tester according to DIN EN 14488.

TABLE 1

| Example | Fibre content [wt. %] | Flexural modulus [MPa] | Bending force [MPa] | Elongation at break [%] |
|---|---|---|---|---|
| 1 | 0 | 718 | 2.10 | 0.5 |
| 2 | 0.2 | 730 | 2.5 | 0.7 |
| 3 | 0.6 | 820 | 3.1 | 0.9 |
| 4 | 1 | 1200 | 4.2 | 1.1 |

EXAMPLES 5 AND 6

Embodiment as per Examples 1-4 without tensile load

TABLE 2

| Example | Fibre content [wt. %] | Flexural modulus [MPa] | Bending force [MPa] | Elongation at break [%] |
|---|---|---|---|---|
| 5 | 0.2 | 718 | 2.3 | 0.6 |
| 6 | 1 | 740 | 2.7 | 0.9 |

EXAMPLE 7

Embodiment as per Examples 1-4. In addition, a woven fabric in plain weave, produced from regenerated cellulose yarns Cordenka 700 (1840 dtex), is inserted into the mould. Weight per unit area 400 g/m$^2$.

TABLE 3

| Example | Fibre content [wt. %] | Flexural modulus [MPa] | Bending force [MPa] | Elongation at break [%] |
|---|---|---|---|---|
| 7 | 1 + Woven fabric | 1350 | 4.6 | 1.1 |

The invention claimed is:

1. A method for producing a prestressed concrete body, characterised in that 1.) filament yarns based on cellulose and/or derivatives thereof are clamped into a shaping container, 2.) the clamped filament yarns are wetted with water to make them swell, characterized in that 0.5 to 2 g of water is used for 1 g of filament yarn, 3.) a prestress of approximately 0.5 to 10.0 kg/4000 dtex is applied to the wetted filament yarns, 4.) liquid concrete is poured into the shaping container containing the prestressed filament yarns, 5.) the liquid concrete in the shaping container is cured to form a precast concrete, maintaining the specified applied prestress.

2. The method according to claim 1, characterised in that the prestress in step 3.) is set to approximately 1.0 kg to 8.0 kg/4000 dtex.

3. The method according to claim 1, characterised in that the fineness of the individual filaments of the prestressed and optionally non-prestressed filament yarns is approximately 0.4 to 10.0 dtex.

4. The method according to claim 1, characterised in that the prestressed filament yarns are contained in the liquid concrete introduced in step 4.) in an amount of approximately 0.1 to approximately 20 wt %.

5. The method according to claim 1, characterised in that in addition to the prestressed filament yarns, non-prestressed filament yarns are incorporated into the method before step 4.).

6. The method according to claim 5, characterised in that the yarns are textiles present in the form of woven fabrics, warp-knitted fabrics, laid scrims, nonwoven fabrics and/or weft-knitted fabrics.

7. The method according to claim 5, characterised in that regenerated cellulose yarns produced by the viscose or the lyocell method or by spinning of cellulose from ionic liquids, are used as filament yarns for providing prestressed filament yarns in the prestressed concrete.

8. The method according to claim 7, characterised in that the filament yarns are based on cord fibres.

9. A prestressed concrete body, obtainable by the method according to claim 1 and characterised in that the prestressed concrete body contains prestressed filament yarns based on cellulose and/or cellulose derivatives.

10. The prestressed concrete body according to claim 9, characterised in that the prestressed concrete body contains approximately 0.1 to 20 wt. % prestressed filament yarns.

11. The prestressed concrete body according to claim 9, characterised in that the prestressed concrete body additionally contains non-prestressed filament yarns.

12. The prestressed concrete body according to claim 11, characterised in that the textiles are present in the form of woven fabrics, warp-knitted fabrics, laid scrims, nonwoven fabrics and/or weft-knitted fabrics.

13. The prestressed concrete body according to claim 9, characterised in that the prestressed filament yarns are based on regenerated cellulose fibres produced by the viscose or the lyocell method or by spinning cellulose from solution thereof in ionic liquids.

14. The prestressed concrete body according to claim 13, characterised in that the prestressed filament yarns are based on viscose fibres in the form of cord fibres.

15. The prestressed concrete body according to claim 9, characterised in that the prestressed concrete body contains prestressed filament yarns based on cellulose derivatives in the form of cellulose esters cellulose acetate and/or cellulose allophanate.

16. The prestressed concrete body according to claim 9, characterised in that the filament yarns are arranged in parallel in one or more planes.

17. The prestressed concrete body according to claim 9, characterised in that the prestressed concrete body has a flexural modulus of approximately 20 GPa to 0.1 GPa (according to DIN EN 14488/year 2005), a bending force of approximately 100 to 0.2 (according to DIN EN 14488/year 2005), and/or an elongation at break of approximately 5 to 0.5 (according to DIN EN 14488/year 2005).

18. A component or structural element for bridge building, constructing containers, constructing high-rise structures, the production of hollow floors or ceilings, precast floors or ceilings and for recycling once the service life has passed by being ground into concrete granules, said component or structured element having low brittleness and/or high resistance to corrosion and being compound of the prestressed concrete of claim 9.

19. The method according to claim 1, characterised in that the prestress in step 3.) is set to approximately 2.0 kg to 6.0 kg/4000 dtex; the finenss of the individual filaments of the prestressed and optionally non-prestressed filament yarns is approximately 1.0 to 3.0 dtex; the prestressed filament yarns are contained in the liquid concrete introduced in step 4.) in an amount of approximately 1.0 to 6.0 wt. %; the prestressed concrete body contains approximately 1.0 to 6.0 wt. % prestressed filament yarns; and the prestressed concrete body contains prestressed filament yarns based on cellulose acetate and/or cellulose allophanate.

* * * * *